US006136370A

United States Patent [19]

Muthiah et al.

[11] Patent Number: 6,136,370

[45] Date of Patent: Oct. 24, 2000

[54] METHOD OF POWDER COATING A SUBSTRATE

[75] Inventors: Jeno Muthiah, Wernesvile; Paul R. Horinka, Reading; Jeffrey B. Farro, New Ringgold; Joseph Kozlowski, Reading, all of Pa.; Robert M. Didrick, Elmhurst, Ill.

[73] Assignee: Morton International, Inc., Chicago, Ill.

[21] Appl. No.: 09/356,224

[22] Filed: Jul. 16, 1999

[51] Int. Cl.[7] ..... B05D 1/12

[52] U.S. Cl. ..... 427/189; 427/195; 427/325; 427/485

[58] Field of Search ..... 427/195, 299, 427/324–326, 444, 475, 485, 296, 297, 189

[56] References Cited

U.S. PATENT DOCUMENTS 5,824,373 10/1998 Biller et al. .

5,882,730 3/1999 Kimura et al. .

FOREIGN PATENT DOCUMENTS 2 273 718 6/1994 United Kingdom .

*Primary Examiner*—Fred J. Parker

[57] ABSTRACT

In substrates, such as wood substrates, having sharp edges, corners and other surface discontinuities, in a front appearance surface, non-functional machining, such as formation of grooves, is performed on the rear non-appearance surface adjacent the surface discontinuities. Coating powder is applied, e.g., electrostatically, to the appearance surface of the substrate and the coating powder fused or fused and cured to form a continuous coating on the appearance surface of the substrate. The rear surface machining reduces cracking of the coating at the front surface discontinuities.

In some cases, non-functional machining is distributed over the entire non-appearance surface of the work-piece to promote out-gassing of volatiles to the non-appearance surface, thereby eliminating out-gassing-caused defects in the coating formed on the appearance surface.

6 Claims, 2 Drawing Sheets

METHOD OF POWDER COATING A SUBSTRATE

This invention is directed to applying powder coating a substrate, particularly a heat-sensitive substrate such as wood and particularly fiberboard, and fusing or fusing/curing the applied coating powder to form a continuous coating. In particular, the invention is directed to reducing cracking or other blemishes of coating powder-derived coatings. Particular attention is paid to reducing failure or blemishes in coatings at edges or corners of workpieces, although the invention is generally directed to reducing failure and blemishes throughout the coating.

BACKGROUND OF THE INVENTION

Powder coatings, which are dry, finely divided, free flowing, solid materials at room temperature, have gained considerable popularity in recent years over liquid coatings for a number of reasons. For one, powder coatings are user and environmentally friendly materials, since they are virtually free of harmful fugitive organic solvent carriers that are normally present in liquid coatings. Powder coatings, therefore, give off little, if any, volatile materials to the environment when cured. This eliminates the solvent emission problems associated with liquid coatings, such as air pollution and dangers to the health of workers employed in coating operations.

Powder coatings are also clean and convenient to use. They are applied in a clean manner over the substrate, since they are in dry, solid form. The powders are easily swept up in the event of a spill and do not require special cleaning and spill containment supplies, as do liquid coatings. Working hygiene is, thus, improved. No messy liquids are used that adhere to worker's clothes and to the coating equipment, which leads to increased machine downtime and clean up costs.

Powder coatings are essentially 100% recyclable. Over sprayed powders can be fully reclaimed and recombined with the powder feed. This provides very high coating efficiencies and also substantially reduces the amount of waste generated. Recycling of liquid coatings during application is not done, which leads to increased waste and hazardous waste disposal costs.

In the past, most powder coating was performed on metals which can withstand high temperatures at which many conventional coating powders fuse and cure. Recently, however, several coating powders have been developed for substrates, such as wood, fiberboard, certain plastics, etc., which require coating powders which fuse (in the case of thermoplastic coating powders) or fuse and cure (in the case of curable coating powders) at relatively low temperatures. Examples of such coating powders are found, for example, in U.S. Pat. Nos. 5,824,373, 5,714,206, 5,721,052, and 5,731,043, the teachings of each of which are incorporated herein by reference. Low temperature coating prevents charring of the substrate and helps to prevent excessive outgassing of moisture.

A frequent problem encountered when coating low-temperature substrates, such as wood, with coating powder is non-uniformity of coating in areas of the substrate which are difficult to coat, such as the edges and corners of kitchen cabinet doors. A frequently observed defect at edges, corners and other surface discontinuities is cracking. While applicants are not bound by theory, such cracking at edges, corners, etc. may be the result of differential thermal expansion and contraction of the substrate and the fusing (in the case of thermoplastic coating powders) and fusing and curing (in the case of curable coating powders) coatings. Coating powders for heat-sensitive substrates, such as wood, are typically fused and cured at temperatures between about 200 and about 350° F. (between about 93 and about 177° C.); and coating powders for other substrates at temperatures up to about 450° F. (449° C.). Coatings produced from coating powders are further vulnerable to cracking at edges and corners because such coatings are relatively thick, i.e., typically being between about 3 and about 10 mils thick (75 to 250 microns).

Accordingly, it is a general object of the present invention to reduce cracking of coatings, derived from coating powders, particularly at surface discontinuities.

Cellulosic substrates, such as wood, fiberboard, etc. generally contain some moisture, e.g., between about 3 and about 10 wt %. This moisture is advantageous for electrostatic application of coating powder in that it enables the otherwise non-conductive material to hold sufficient electrical charge for efficient electrostatic coating powder application. However, the moisture is also disadvantageous in that outgassing of moisture, as well as outgassing of other volatiles, during fusing or fusing/curing, can lead to defects such as pinholes or blisters in the coating. In a wood substrate of generally uniform density and composition, outgassing may be relatively evenly distributed throughout the surfaces and edges. In medium- to high-density fiberboard which is denser in surface regions than interior regions, outgassing is particularly problematic at the machined edges because the less dense interior core region provides a lateral pathway for outgassing volatiles.

Accordingly, it is further an object of the invention to reduce defects in substrates containing water and other volatile chemicals which may outgas during fusing or fusing/curing of the coating powder.

SUMMARY OF THE INVENTION

In accordance with one aspect of the invention, substrates having edges, corners, profiles or other discontinuities as a front appearance side are grooved, e.g., routed or drilled, on a rear non-appearance side adjacent the edges, corners and other front surface discontinuities. Coating powder is applied to the front appearance side, including the edges, corners, and other surface discontinuities. The grooving in the rear side acts to reduce cracking of the fused or fused-and-cured coating.

In accordance with another aspect of the invention, substrates containing moisture and/or other volatiles, are machined sufficiently on a non-appearance side of the substrate so as to provide sufficient pathways for outgassing on the non-appearance side such that outgassing-caused defects in the coating on the appearance side are minimized or eliminated.

DETAILED DESCRIPTION OF CERTAIN PREFERRED EMBODIMENTS

The present invention is most particularly applicable to substrates which might be considered to have an "appearance side" and a "non-appearance" side and which are to be coated on the appearance side, including edges, corners, and other surface discontinuities. Many substrates fit this description. For example, fiberboards for forming kitchen cabinet doors or inexpensive furniture typically have an outside surface which must be coated for appearance and an inside surface in which appearance is substantially less critical. In other workpieces, such as floor moldings, a non-appearance side is covered entirely when in place. Although the present invention involves substantial non-functional machining (other than the stress-relief and out-gassing-relief functions of the present invention) this does not mean that the machining must detract from the non-appearance side of the workpiece, and may, in fact, be designed to give the impression of intentional aesthetic design.

The invention is generally directed to any substrate having edges, corners, or other surface discontinuities. The invention is especially directed to heat-sensitive substrates such as certain plastics and lignocellulosic substrates. Lignocellulosic material herein is intended to include fibrous material whether derived from trees or other plants and whether such material is in its natural state or its fibers have been separated, felted and/or compressed. Thus, in addition to wood, lignocellulosic material includes hardboard, medium and high density fiber board, particle board, oriented strand board, and paper. In regard to paper, the invention may not be directly applicable to paper by itself, but is applicable to paper-covered substrates.

The invention is directed to all types of coating powder, regardless of resin chemistries. The invention is directed to thermoplastic coating powders which are applied, e.g., electrostatically, to a substrate and then heated to fuse the powder into a uniform continuous coating. The invention is also directed to curable coating powders which are applied, e.g., electrostatically, to a substrate and subsequently heated to fuse the coating powder into a continuous coating and cured. Such cure may be by heat, UV-light, or a combination of heat and UV light.

Figure 1:
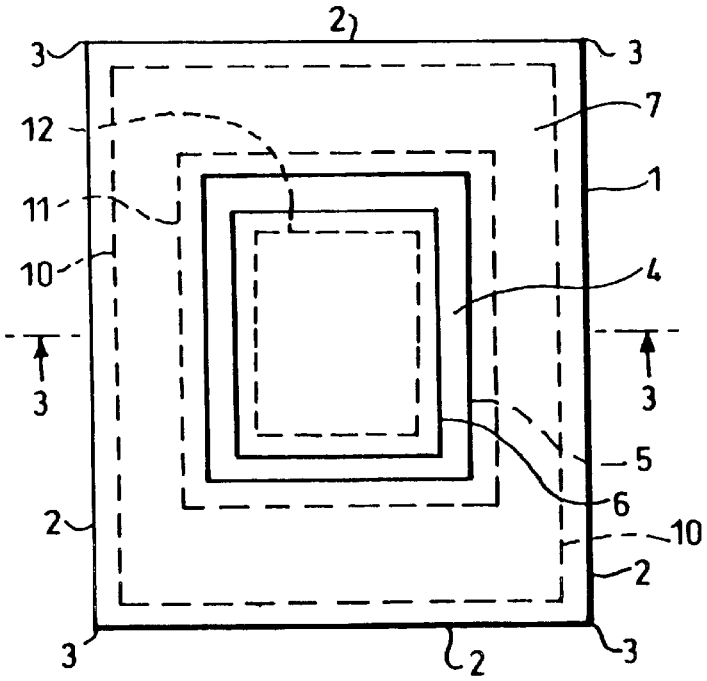
FIG. 1 is a plan view of a front or appearance surface of a substrate, such as might serve as a kitchen cabinet door.
Figure 2:
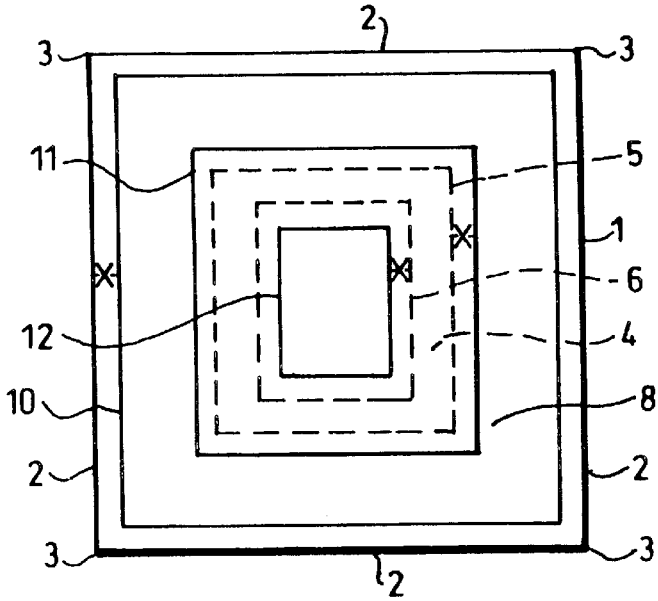
FIG. 2 is a rear or non-appearance surface of the substrate of FIG. 1.
Figure 3:
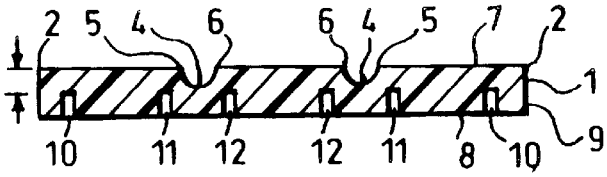
FIG. 3 is a cross-sectional view of the substrate taken along line 3—3 of FIG. 1.

Illustrated in FIGS. 1–3 is a substrate 1 which may be formed of wood or fiberboard and which may serve as a door for a kitchen cabinet. It is to such substrates that there is a good deal of current interest for the application of powder coating. The illustrated substrate 1 is rectangular, having edges 2 and corners 3. The illustrated substrate 1 is also shown with a grooved design 4 having an outer edge 5 and an inner edge 6. The front surface 7 illustrated in FIG. 1 will be considered to be an appearance surface while the rear surface 8 illustrated in FIG. 2 will be considered to be a non-appearance surface. The coating is to be applied to the front surface 7, including the edges 2, corners 3, and surfaces 9 (FIG. 3). In coating substrates, cracking is often encountered at discontinuities in the surface, such as the edges 2, corners 3, and the edges 5 and 6 along the grooved design.

In accordance with the invention, there are provided in the rear or non-appearance surface 8 of the substrate 1, grooves extending along the surface discontinuities of the substrate, including rectangular groove 10 along the edges of the substrate, rectangular groove 11 adjacent the outer edge 5 of the design 4, and rectangular groove 12 adjacent the inner edge 6 of the design 4. Such grooves, 10, 11, and 12 may be formed by router or by a saw cut or any other convenient method of machining a substrate. While applicants are not bound by theory, it is believed that cracking at the surface discontinuities is a result of stress caused by differential coefficients of thermal expansion between the coating and substrate. That is, as the coating cools from its fusing or fusing/curing temperature, the differential contraction of the coating and substrate results in cracking at the edges and corners. Herein it is found that the grooves 10, 11 and 12 reduce or eliminate cracking at corners, edges and other surface discontinuities, presumably by relieving stress.

The grooves 10, 11, and 12, to be effective for stress-relief, must be a lateral distance X from the surface discontinuities which is relatively small. This distance X will depend upon the nature of the substrate, e.g., the strength and flexibility of the substrate, but in cellulosic materials will generally be between about 1 and about 25 cm, typically between about 2 and about 10 cm. Of course, the distance X must not be so small that the structural integrity of the substrate is compromised.

In practice, the distance X as well as other machining parameters, such as depth of machining, extent of machining, etc. will depend upon a variety of factors such as the nature of the substrate, moisture content of the substrate, substrate density, substrate density profile, type and composition of the coating powder, processing parameters such as temperature and time of fusing or fusing/curing, etc. Machining in accordance with the invention on a non-appearance surface for stress-relief or to facilitate out-gassing to the non-appearance surface is to be distinguished from the more minimal functional machining typically involved in preparing a work-piece. A work-piece will typically be machined for subsequent application of hardware such as screws, nails, hinges, etc., but such functional machining is generally not evenly distributed across the workpiece and is generally insufficient for stress-relief and outgassing-relief in accordance with the invention. Thus, "machining" for purposes of the invention is machining substantially in excess of that required for functional purposes. The degree of "machining" and location of "machining" required for purposes of the present invention will generally be empirically determined. For example, if when powder coating a workpiece, edge or surface defects are noted, machining in accordance with the invention will be performed in the non-appearance surface so as to alleviate stress or provide out-gassing pathways to the non-appearance surface of the workpiece.

Figure 4:
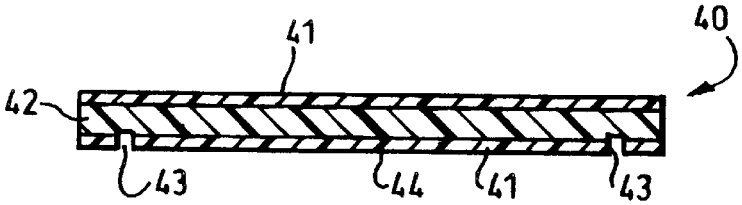
FIG. 4 is a cross-sectional view of a fiberboard workpiece formed as a three-layer structure and machined in accordance with the invention.

Some particular problems with certain substrates are to be noted. High- or medium-density fiberboard is generally substantially more dense adjacent to the surfaces than in interior regions. Such a density profile will naturally occur in fiberboard which is formed by compressing a fiber composition. This distribution, however, is generally enhanced by design. Typically, in the pre-pressed fiber preparation, three fiber layers are provided with the intention that the outer layers form more densely than the core layer, thereby providing surface toughness while reducing weight at the core. When such fiberboard is cut into workpieces, such as for kitchen cabinet doors, the less dense core layer is exposed. In such pieces, the dense surface layers may provide substantial barrier to out-gassing, whereby volatiles tend to travel a lateral path to the machined edges or the workpiece, causing significant outgassing problems at the edges. Accordingly, machining such a work-piece on its non-appearance surface closely adjacent the edge, as per FIGS. 1–3, will provide not only stress-relief, but outgassing relief as well. In fiberboard having denser surface regions and a less dense core layer, it is necessary to machine at least through the dense surface layer on the non-appearance surface of the workpiece. In a fiberboard deliberately formed as a three-layer composite, this will be through the dense surface layer of the non-appearance surface. Illustrated in FIG. 4 is a cross-section of a fiberboard workpiece 40 formed as a three-layer composite having dense outer layers 41 and a less dense interior core 42. Grooves 43 are formed from a non-appearance surface 44 of the board to a depth extending through the dense outer lay 41 on the non-appearance surface. In a fiberboard in which a density gradient is formed merely from the result of the compaction process, it is generally sufficient to machine to a depth to whereat the density is 80% or less of the density of the surface.

Figure 5:
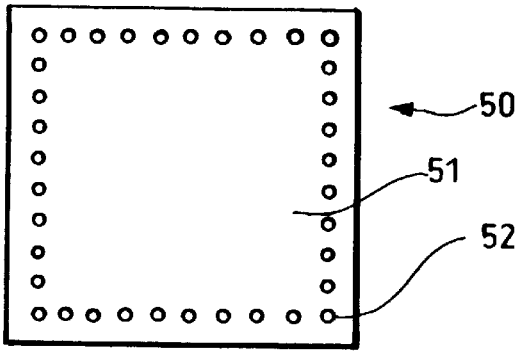
FIG. 5 is a plan view of the rear or non-appearance surface of a workpiece machined in an alternate manner in accordance with the invention.

While FIGS. 1–3 show continuous grooves formed adjacent surface discontinuities, other machining may serve for the same purpose. Illustrated in FIG. 5 is a non-appearance surface 51 of a workpiece 50 having a pattern of notches 52 drilled along the edges of the workpiece.

Figure 6:
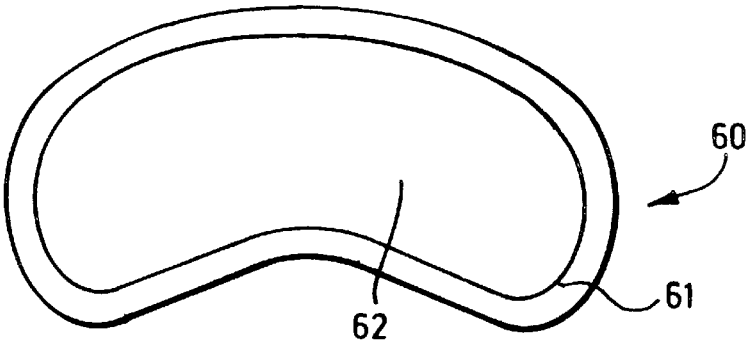
FIG. 6 is a plan view of the rear or non-appearance surface of a contoured workpiece in which a contoured groove is formed along the contoured edges of the workpiece.

Illustrated in FIG. 6 is the non-appearance surface of a "kidney-shaped" workpiece 60 which may serve as a desktop. A "kidney-shaped" groove 61 is formed into the non-appearance surface 62 of the work-piece for stress-relief and/or outgassing-relief. Such a contoured workpiece is typically cut by a computer-guided saw. The same computer guidance can be employed to guide a router closely adjacent the edge contours of the workpiece to form the groove 61.

Figure 7:
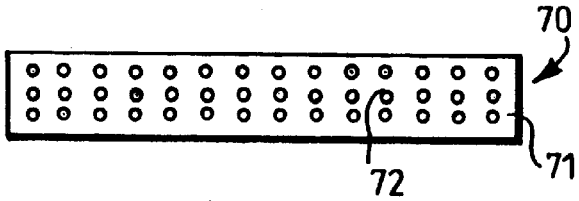
FIG. 7 is a plan view of the rear or non-appearance surface of a wood workpiece machined in accordance with the invention in a manner that reduces out-gassing to the front or appearance surface of the workpiece.

A wood substrate may present a different problem than a fiberboard substrate. Wood, unlike high- or medium-density fiberboard, has a surface density that is low enough to permit volatiles to outgas over the entire surface, generally along the grain pattern. Illustrated in FIG. 7 is the non-appearance surface 71 of a wood workpiece 70 which might be used for floor molding. In this workpiece, an array of notches 72 are drilled into the entire non-appearance surface of the workpiece for out-gassing relief. Such an array of circular notches might be formed simultaneously using an array of drill bits. It may even be convenient in some cases to perforate a non-appearance shape of fiberboard with an array of holes prior to cutting the board to shape. Perforations to permit outgassing on a non-appearance side need not be large, and may even be substantially unseen by the naked eye.

What is claimed is:

1. On a substrate having a front appearance surface, an opposing rear non-appearance surface, and front surface discontinuities, a method for forming a continuous coating on said front appearance surface including said front surface discontinuities, the method comprising, non-functionally machining said rear non-appearance surface sufficiently to minimize coating-derived stresses at said front surface discontinuities and sufficiently to vent out-gassing volatiles through said rear non-appearance surface during s subsequent fusing or curing step to promote uniform continuous coating formation on said front-appearing surface, including said surface discontinuities, applying coating powder on said front appearance surface, including said surface discontinuities, and fusing or curing a smooth, continuous coating from said applied coating powder.

2. The method according to claim 1 wherein said non-functional machining of said rear non-appearance surface is a lateral distance from said surface discontinuities between about 1 and about 25 cm.

3. The method according to claim 1 wherein said non-functional machining of said rear non-appearance surface is a lateral distance from said surface discontinuities between about 2 and about 10 cm.

4. The method according to claim 1 wherein said substrate is a three-layer fiberboard having denser surface layers sandwiching a less-dense core layer, and wherein said non-functional machining extends at least through the denser surface layer on said rear non-appearance surface.

5. The method according to claim 1 wherein said substrate is a fiberboard workpiece having a natural density gradient from a dense surface to a less dense interior caused by compaction of the fiber composition used to form said fiberboard workpiece, said non-functional machining being performed to a depth into the interior to where the density is about 80% or less of the surface density.

6. The method according to claim 1 wherein said substrate is a wood workpiece and said non-functional machining is distributed across said rear non-appearance surface of said workpiece to promote out-gassing of volatiles away from said front appearance surface of said workpiece.

* * * * *